United States Patent [19]

Prewer

[11] Patent Number: 4,530,200

[45] Date of Patent: Jul. 23, 1985

[54] DISPENSING ARRANGEMENT FOR ADVERTISING COUPONS

[75] Inventor: Richard W. Prewer, Markham, Canada

[73] Assignee: International In-Store Sales Limited, Markham, Canada

[21] Appl. No.: 502,335

[22] Filed: Jun. 8, 1983

[51] Int. Cl.[3] ..... B65H 5/06; B65B 61/20

[52] U.S. Cl. ..... 53/157; 221/231; 221/259; 271/126; 271/149; 271/160; 271/162; 271/171

[58] Field of Search ..... 53/50, 156, 157, 246; 221/231, 259, 277, 285; 271/10, 126, 149, 150, 160, 171, 162, 164

[56] References Cited

U.S. PATENT DOCUMENTS

| | | | |
|---|---|---|---|
| 464,704 | 12/1891 | Bickford | 271/149 |
| 540,814 | 6/1895 | Knowles | 271/10 |
| 2,759,729 | 8/1956 | Hedlun | 271/10 |
| 4,039,181 | 8/1977 | Prewer | 271/10 |
| 4,473,172 | 9/1984 | Reynolds | 221/231 |

*Primary Examiner*—Robert L. Spruill
*Assistant Examiner*—Richard M. Mudd
*Attorney, Agent, or Firm*—Kirschstein, Kirschstein, Ottinger & Israel

[57] ABSTRACT

A dispensing arrangement for dispensing advertising coupons in their folded state into containers having upstanding reinforcing ribs adjoined by respective depressions on those portions thereof onto which the coupons are to be dispensed includes a chute that bounds a downwardly sloping channel for accomodating a stack of the coupons in substantially vertical orientations, a pusher element which presses the stack against a transverse wall delimiting the channel at its dispensing end, a withdrawing roller which withdraws the foremost of the folded coupons in the stack, and a pair of advancing rollers which advance the withdrawn coupon and discharge the same into the depression of the respective container next to the upstanding reinforcing rib. The chute is advantageously a removable separate component of the arrangement, which is clipped on the body of the dispensing arrangement and whose walls can be moved relative to one another to adjust the width of the channel. The pusher element has a hook which can engage behind the end of the chute during the formation of the stack of the folded coupons, to keep the pusher away from the area of the stack and yet to avoid misplacement of the pusher element. The body of the dispensing arrangement is mounted on a support for displacement relative thereto in two perpendicular horizontal directions to adjust the position of the dispensing arrangement relative to the container in its dispensing position.

25 Claims, 10 Drawing Figures

24
26
18
27
25
29
21
20
17
18
56
19
60
53
58
11
70
71
69
15
61
68
33
14
18
19
16
61
60
70
71
69
68
74

DISPENSING ARRANGEMENT FOR ADVERTISING COUPONS

BACKGROUND OF THE INVENTION

The present invention relates to dispensing arrangements in general, and more particularly to a dispensing arrangement for advertising or promotional coupons or the like.

With the widespread use of advertising, it is sometimes desired or even necessary, to obtain competitive advantage, to include advertising or promotional coupons, such as discount or rebate coupons, in containers, such as egg cartons. One arrangement of this type is disclosed in the U.S. Pat. No. 4,039,181. The coupon dispensing arrangement disclosed therein works reasonably well when the lid of the egg carton has a large flat internal surface. Under these circumstances, the advertising coupon can be dispensed onto this internal surface in an almost haphazard manner, since the large area of this surface gives sufficient leeway even for rather imprecise dispensing of the coupon. Moreover, the coupon can be dispensed in its state as a single layer of sheet material, again because of the hugeness of the surface onto which the coupon is dispensed.

However, in recent years, the trend was toward egg cartons which are made of less material, be it because the wall thickness is reduced, or because the lid is provided with cutouts through which the integrity of the eggs can be observed without opening the carton. Under these conditions, the lid having a flat central portion would not have a sufficient rigidity and, consequently, it is necessary to provide the lid with at least one projection which stiffens the lid. Depending on the manufacturer of the egg carton, the reinforcing rib may extend either in the longitudinal direction, or in the transverse direction, of the egg carton. Now, if it were attempted to dispense the flat coupon onto the internal surface of the lid of this construction, the projecting reinforcing rib would either deflect the descending coupon either out of the egg carton, or onto the hinge which pivotally connects the lid with the bottom of the egg carton, or the coupon would rest on top of the lid. Hence, the coupon would either be missing from the egg carton, or would be so positioned that it could interfere with the closing of the egg carton. Obviously, one egg carton which cannot be closed because of the interference from the coupon stops the entire packaging line. Moreover, even if the coupon does not interfere with the closing of the egg carton, it could become mutilated, so that the very purpose of inserting the coupon into the egg carton could be defeated. All this is very disadvantageous.

SUMMARY OF THE INVENTION

Accordingly, it is a general object of the present invention to avoid the disadvantages of the prior art.

More particularly, it is an object of the present invention to provide an arrangement for dispensing advertising or similar coupons into open containers, such as egg cartons, which arrangement does not possess the disadvantages of the conventional arrangements of this type.

Still another object of the present invention is so to construct the arrangement of the type here under consideration as to reduce the danger of interference of the dispensed coupon with the closing of the egg carton to a minimum, if not eliminate the same altogether.

It is yet another object of the present invention to develop a dispensing arrangement of the above type which is capable of very precisely dispensing the coupons and which is easily convertible between dispensing single-layer and multilayer flexible articles.

A concomitant object of the present invention is so to design the dispensing arrangement as to be simple in construction, inexpensive to manufacture, easy to use, and reliable in operation nevertheless.

In pursuance of these objects and others which will become apparent hereafter, one feature of the present invention resides in an arrangement for dispensing articles of flexible sheet material into upwardly open containers, this arrangement comprising, succinctly stated, means for bounding a channel for accommodating a stack of the articles in their folded state and for individually guiding the folded articles toward a dispensing end of the channel that is situated upwardly of the respective container during the dispensing operation; and means for individually withdrawing the folded articles from the stack and for advancing the same toward and beyond the dispensing end of the channel during the dispensing operation for dispensing the respective folded articles into the respective containers.

The arrangement as described so far has the advantage that, since the articles, especially coupons, are accommodated in the channel in their folded state, and dispensed in this form, they are very unlikely to become so positioned as to interfere with the closing of the egg carton even when the lid is provided with an upstanding rib. This is attributable, on the one hand, to the increased weight-to-surface ratio of the article, which increases the rate of descent of the article into the container and reduces the danger of gliding, and on the other hand, to the reduced width of the article which reduces the likelihood of dispensing the article directly onto the upstanding reinforcing projection or rib.

According to one facet of the present invention, the dispensing arrangement of the present invention is to be used in conjunction with containers having respective reinforcing ribs and adjacent depressions at those portions thereof onto which the folded articles are to be dispensed. In this case, the dispensing end of the channel is situated upwardly of the respective depression during the dispensing operation. This feature assures that the coupon being dispensed will descend into the depression, rather than onto the reinforcing rib or onto the hinge.

When the dispensing arrangement of the present invention is used with containers which are elongated in one horizontal direction as considered in the position assumed during the dispensing operation, and whose reinforcing ribs extend longitudinally thereof and depressions have a predetermined width, the aforementioned channel has a width substantially corresponding to the predetermined width for accommodating the folded articles with a width at most equal to the predetermined width. On the other hand, when the ribs extend transversely of the longitudinal direction of the container and slope into the depressions, such that the depressions have a predetermined dimension between the crests of the reinforcing ribs and the bottoms thereof, the channel has a width substantially corresponding to the predetermined dimension for accommodating the folded articles with a width at most equal to the predetermined dimension.

Advantageously, the channel has a bottom surface which slopes downwardly toward the dispensing end of the channel. Then, there may be advantageously provided means for maintaining the folded articles of the stack in substantially upright positions within the channel prior to the withdrawal thereof from the stack. The maintaining means preferably includes a pusher element of hollow configuration, which is slidably supported on the inclined bottom surface on the opposite side of the stack from the dispensing end of the channel and engaging the last folded article of the stack. This pusher element is advantageously of a rigid sheet material.

According to a currently preferred concept of the present invention, the bounding means includes a chute having an engaging portion at an end of the channel which is remote from the dispensing end. Then, the pusher element advantageously has a substantially hook-shaped portion adapted to engage behind the engaging portion of the chute during the introduction of the folded articles into the channel. The pusher element is advantageously capable of assuming two different orientations in the channel, in one of which it engages the stack from behind and slides on the inclined bottom surface, while the hook-shaped portion thereof extends away from the engaging portion of the chute, and in the other of which the hook-shaped portion engages behind the engaging portion of the chute and keeps the pusher element at a predetermined distance from the stack against sliding on the inclined bottom surface.

In an advantageous construction of the dispensing arrangement of the present invention, the bounding means includes a chute having two lateral walls laterally delimiting the channel, at least one of the lateral walls being mounted on the remainder of the chute for displacement transversely of the channel for adjustment of the width of the channel, and being arrestable in the selected adjusted position thereof for maintaining the selected width of the channel.

It is further advantageous when there is provided a support body which supports the bounding means, and means for holding the support body at a predetermined position relative to the respective container at least during the dispensing operation. The holding means advantageously includes a support assuming a predetermined position relative to the container during the dispensing operation, and means for mounting the support body on the support for displacement relative to the position of the container during the dipensing operation in two horizontal directions for adjustment of the position of the dispensing end of the channel relative to the container, and for maintaining the support body in the selected adjusted position thereof. This mounting and maintaining means advantageously includes a bracket securable to the support and to the support body, this bracket having a substantially L-shaped configuration having two legs respectively juxtaposed with the support and with the support body. At least one of these legs is provided with at least one elongated slot therein. Respective screws then extend through the slots. The mounting and maintaining means may further include, in accordance with the present invention, an intermediate plate interposed between one of the legs of the bracket and the support body and having elongated slots therein. First additional screws then extend through the slots and engage the support body, and second additional screws secure the intermediate plate to the one leg of the bracket.

When the arrangement of the present invention includes a support body for the bounding means, it is advantageous when it includes an inclined support wall extending in the longitudinal direction of the channel, and when the bounding means includes a chute separate from the support body and supported thereon, the chute including, at its end remote from the dispensing end of the channel, a substantially hook-shaped end portion which embraces a portion of the support wall. Then, it is advantageous when the support body bounds a recess extending in the longitudinal direction of the channel for receiving the chute. The chute may include a lug at the remote end thereof, and means for determining the position of the chute in the recess in the longitudinal direction of the channel. This determining means advantageously includes a setting screw threadedly engaging the lug and abutting the support body to maintain the lug at a predetermined distance therefrom.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
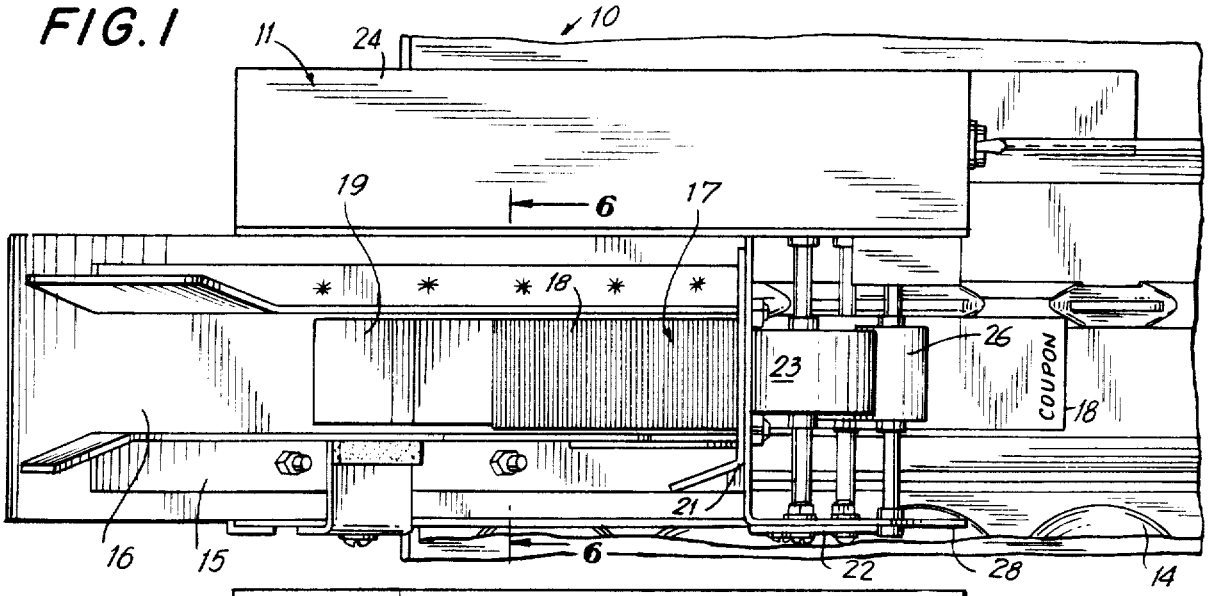
FIG. 1 is a top plan view of the dispensing arrangement of the present invention.

Referring now to the drawing in detail, and first to FIG. 1 thereof, it may be seen that the reference numeral 10 has been used therein to identify a dispensing arrangement of the present invention in its entirety. The dispensing arrangement 10 is in many respects similar to that disclosed in the above-mentioned U.S. Pat. No. 4,039,181, which is hereby incorporated by reference, so that it is not necessary to discuss those features common to both of these arrangements in any great detail beyond what is necessary for understanding the present invention and the differences between the same and the prior art.

Figure 2:
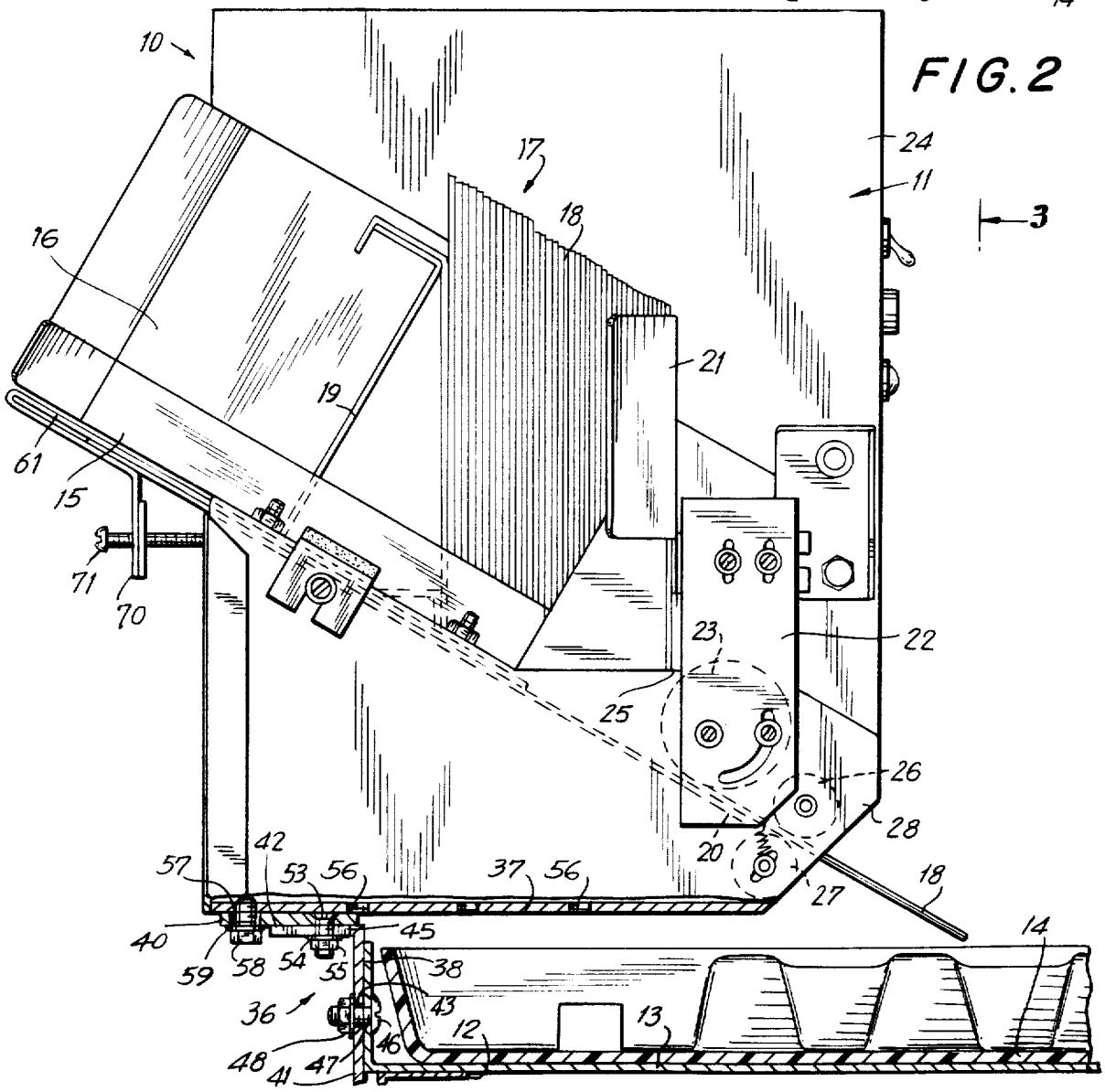
FIG. 2 is a side elevational view of the arrangement of FIG. 1.

The dispensing arrangement 10 includes a body that is generally identified by the reference numeral 11. As shown in FIG. 2, the body 11 is mounted on a support 12 by means of an adjustable mounting bracket arrangement 36 which will be discussed in greater detail later. The support 12 may be constituted, as shown in the drawing, by a stationary conveyor 13 for open containers 14, such as egg cartons, or may have such a conveyor 13, or a different conveyor, mounted thereon. In any event, the mounting bracket arrangement will mount the body 11 in a predetermined position relative to the conveyor 13 and at least partially above the path of movement of the open containers 14 on or with the conveyor 13.

The body 11 supports a chute 15 in a manner that will be discussed later. The chute 15 bounds a channel 16 which is adapted to accommodate, with only minimum clearances in the transverse direction of the channel 16, a stack 17 of folded flexible sheet-shaped articles 18, especially advertising or promotional coupons, in such a manner that the folded articles 18 stand substantially upright when arranged in the stack 17 and received in the channel 16. A weight or pusher element 19 acts on the sheet-shaped articles 18 from behind, as particularly clearly shown in FIG. 2. FIG. 2 also shows that the chute 15 slopes downwardly from left to right as considered in the drawing, that is, toward a dispensing end 20 of the channel 16. Hence, the pusher element 19, when received in the channel 16 in its orientation shown in FIG. 2, is supported on the downwardly inclined bottom surface of the chute 15 and, consequently, presses from behind, that is, from the left as considered in FIGS. 1 and 2, against the last one of the sheet-shaped articles 18 of the stack 17 and thus maintains the entire stack 17 of the articles 18 in the illustrated upright position thereof and urges the entire stack 17 of the articles 18 toward the dispensing end 20 of the channel 16. Advantageously, each of the articles 18 includes two of the aforementioned coupons, each folded in half and connected to the other coupon along one of its edges, particularly that which is parallel to the folds.

The extent of movement of the stack 17 of the flexible articles 18 toward the dispensing end 20 of the channel 16 is delimited by a transverse wall 21 that extends across the channel 16 and rises from the bottom surface of the chute 15 to an extent approximating the height of the folded articles 18 accommodated in the channel 16 in the form of the stack 17. The transverse wall 21 extends substantially vertically and parallel to the front surface of the pusher element 19, so that it cooperates with the latter in maintaining the stack 17 of the folded articles 18 in its illustrated upright position. The transverse wall 21 also determines the position of the foremost one of the folded articles 18 of the stack 17 by serving as an abutment therefor.

The body 11 further includes or carries a mounting portion 22 which, like the transverse wall 21, is stationary relative to the body 11 at least during the use of the dispensing arrangement 10. A withdrawing roller 23 is rotatably supported on the mounting portion 22 for rotation about an axis which is substantially horizontal. The withdrawing roller 23 is driven in rotation by a drive which is not illustrated in any detail since it is of a conventional construction including, for instance, an electric motor. The drive is accommodated in the interior of a housing 24 which is carried by or forms a constituent part of the body 11. The withdrawing roller 23 is arranged at the opposite side of the transverse wall 21 from the chute 15, but it projects through a window 25 situated below or within the transverse wall 21 into engagement with the foremost folded article 18 of the stack 17. The aforementioned drive so rotates the withdrawing roller 23, on an intermittent basis, as to initially displace the foremost one of the folded articles 18 of the stack 17 downwardly, with attendant bending of this folded article 18 at its lower portion along the bottom surface of the channel 16 toward the dispensing end 20, followed by the passage of the folded article 18 through the gap between the withdrawing roller 23 and the bottom surface of the channel 16. A pair of advancing rollers 26 and 27, at least one of which is driven in rotation at least on an intermittent basis, is rotatably mounted on an additional mounting portion 28 of the body 11. The advancing rollers 26 and 27 may be driven from the same drive as the withdrawing roller 23, or by their own drive which is also accommodated in the interior of the housing 24.

Figures 4, 5:
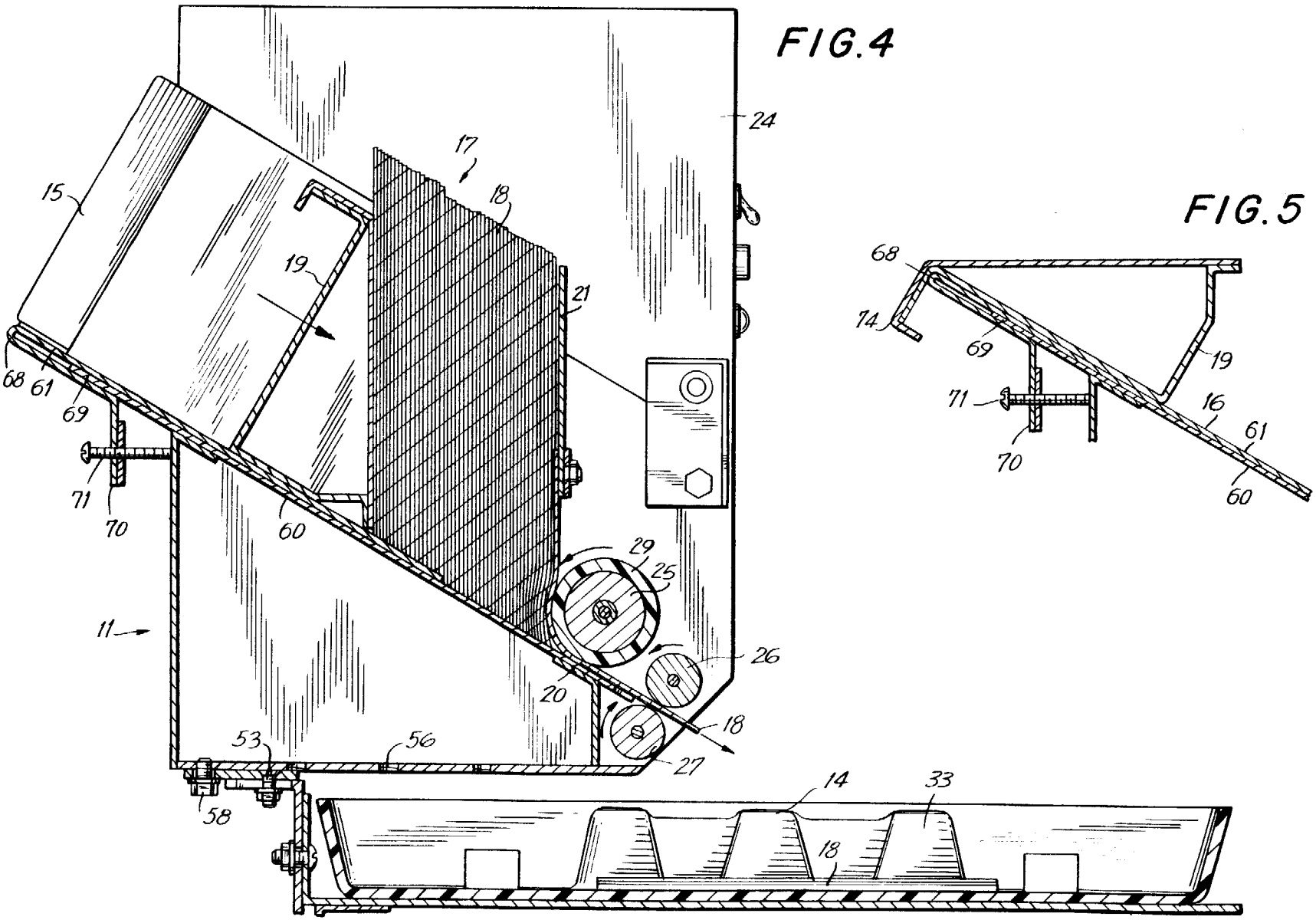
FIG. 4 is a cross-sectional view of the dispensing arrangement, taken in the plane indicated by 4—4 in FIG. 3.
FIG. 5 is a partial sectional view corresponding to that of FIG. 4 but showing only a fragment of the arrangement.

As shown particularly in FIG. 4, the withdrawing roller 25 has a layer 29 of rubber or other high-friction material on its periphery. It is this frictional material layer 29 that engages the foremost folded article 18 and displaces the same, due to the frictional engagement therewith, in the downward direction during the withdrawing operation. FIG. 4 also shows that the flexible folded article 18 being withdrawn bends and thus becomes trained about the lower portion of the withdrawing roller 23 during its withdrawal from the stack 17, to pass through the gap existing between the periphery of the withdrawing roller 23 and the bottom surface of the channel 16 at the dispensing end 20, until it dissociates itself from the withdrawing roller 23 beyond this gap and proceeds along the dispensing end 20 toward and into the nip between the advancing rollers 26 and 27. When this happens, the advancing rollers 26 and 27 engage the folded article 18 being withdrawn and advance the same beyond the dispensing end 20 of the channel 16 and toward the container 14. After completely passing through the nip between the advancing rollers 26 and 27, the folded article 18 descends into the open container 14 then situated in registry with the dispensing end 20 of the channel 16.

Figure 3:
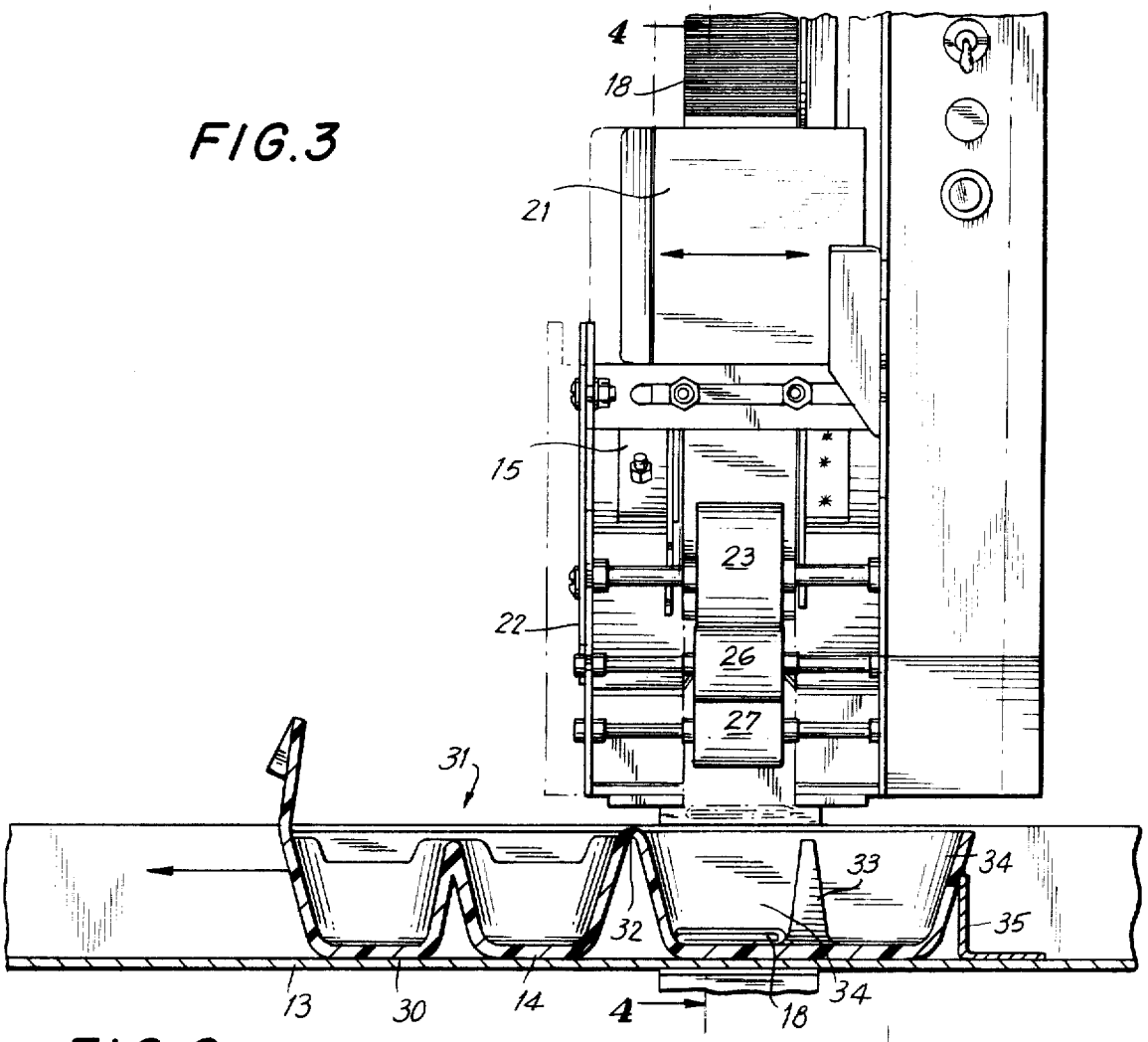
FIG. 3 is a front elevational view of the dispensing arrangement of the present invention, taken in the direction of the arrow 3 of FIG. 2.

As shown in FIGS. 3 and 4, the container or egg carton 14 includes a bottom portion 30 and a lid portion 31 which are connected to one another by a hinge portion 32 for pivoting about the latter between the illustrated open position in which the bottom and lid portions are disposed next to one another, and the closed position of the container 14 in which the lid portion 31 is juxtaposed with the bottom portion 30. The lid portion 31 has a projection 33 that extends in the longitudinal direction of the elongated egg carton 14 and is adjoined by two depressions 34 at least one of which has a width substantially corresponding to the width of the folded article 18 so as to accommodate the same in the illustrated position thereof, in which the dispensed folded article rests on the bottom of the respective depression 34 and is preferably lodged therein. Of course, this requires coordination of movement of the container 14 with the operation of the dispensing arrangement. As shown especially in FIG. 3, this is achieved by making the conveyor 13 substantially trough-shaped and by providing a pusher 35. In this manner, the position of the egg carton 14 on the conveyor 13 is unequivocally determined. Then, a conventional microswitch may be used for commencing the operation of the dispensing arrangement 10 when the egg carton assumes a known position relative to the dispensing arrangement 10. This control is fully conventional, so that no arrangement for achieving this control has been shown in order not to unduly encumber the drawing. The conveyor 13 may be movable, or it may be stationary, as shown, in which case the pusher 35 is movable relative to the stationary trough-shaped conveyor 13 to cause the container 14 to slide thereon. The pusher 35 can be moved in any known manner, such as, for example, by using an endless element, especially a chain, which extends below the conveyor 13 and is connected to the pusher 35 through a slot (omitted from the drawing) in the bottom of the trough-shaped conveyor. However, the pusher 35 could also be moved by an endless element, or a pair of endless elements, extending laterally of the trough-shaped conveyor 13. Of course, if the conveyor 13 were movable, then the mounting bracket arrangement 36 would have to be mounted on its own support 12, rather than on the trough-shaped conveyor 13 as shown in FIG. 2.

Figure 10:
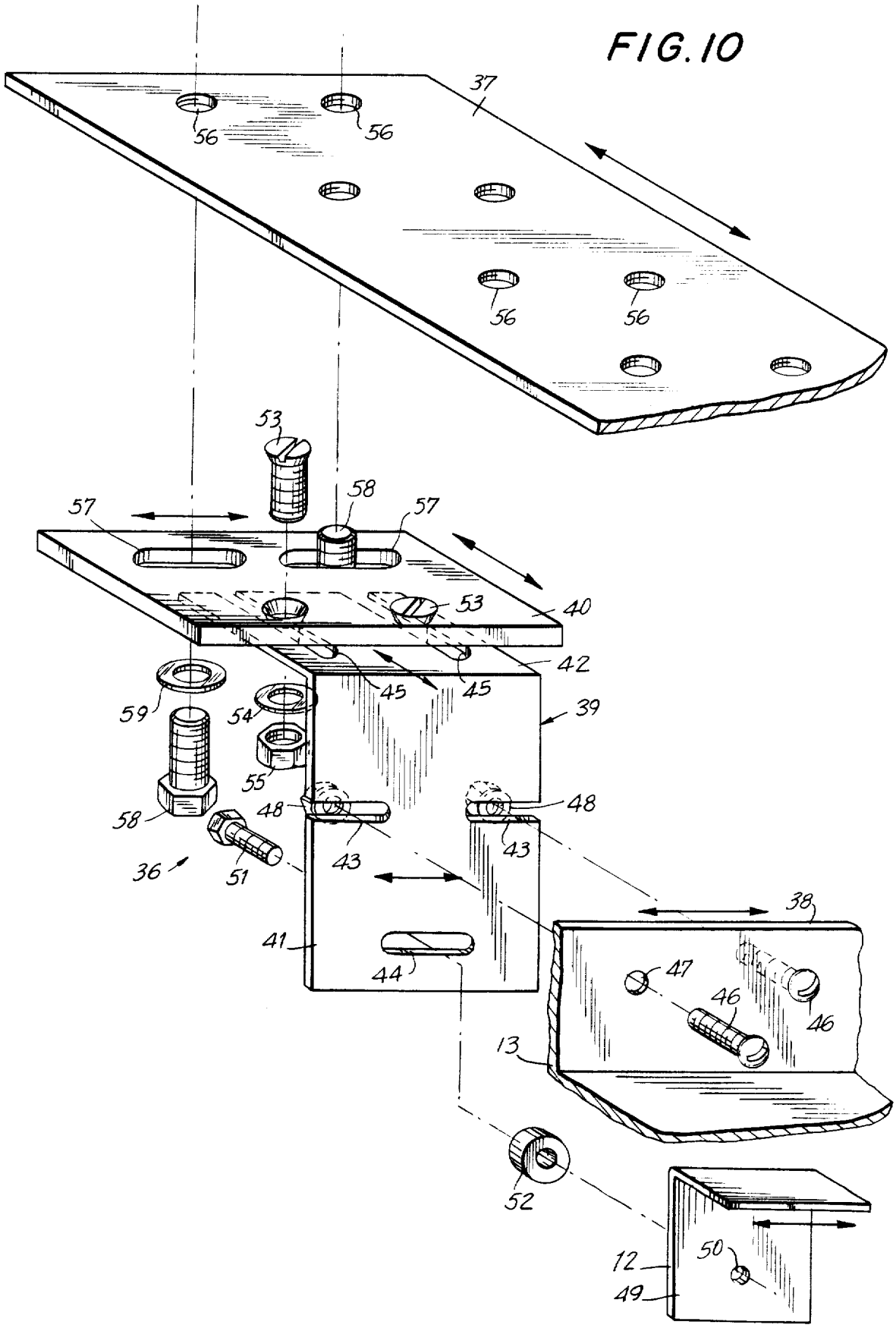
FIG. 10 is an enlarged exploded perspective view of a mounting arrangement for the dispensing arrangement of FIG. 1.

The dispensing arrangement 10 can be adjusted in various ways and directions so as to assure its proper dispensing operation. So, for instance, it may be seen in FIG. 2 that the mounting portion 22 can be adjusted as to its position in the up-and-down directions relative to the body 11, so as to adjust the size of the gap between the withdrawing roller 23 and the bottom of the chute 15. Moreover, the position of the axis of rotation of the withdrawing roller 23 can be adjusted in the manner described in detail in the aforementioned U.S. patent, so as to adjust the extent to which the withdrawing roller 23 projects beyond the transverse wall 21. Still other possibilities of positional adjustment are provided by the adjustable bracket arrangement or assembly 36 which is shown in detail in FIG. 10, which shows that the assembly 36 is interposed between a bottom plate 37 of the arrangement 10 and a side wall 38 of the trough-shaped conveyor 13. The assembly 36 includes, as its main components, a substantially L-shaped bracket 39 and an intermediate plate 40. The bracket 39 has two legs 41 and 42 that are provided with respective slots 43 and 44, on the one hand, and 45, on the other hand. Screws 46 or similar threaded elements extend through respective holes 47 in the lateral wall 38 of the conveyor 13 and through the slots 43 and cooperate with respective nuts 48 to secure the leg 41 of the mounting bracket 39 to the conveyor 13. The support 12 is shown to include a bracket 49 which has a threaded bore 50 therein. A screw 51 extends through the slot 44 of the leg 41 of the mounting bracket 39, passes through a ring-shaped distancing element 52, and is threaded into the threaded bore 50 of the bracket 49. Thus, it may be seen that, so long as the screws 46 and 51 are loose, the mounting bracket 39 can be moved in the longitudinal direction of the conveyor 13 to the extent allowed by the slots 43 and 44, while tightening of the screws 46 and 51 or of the nuts 48 will arrest the bracket in the then assumed position relative to the conveyor 13.

The intermediate plate 40 is mounted on the other leg 42 of the mounting bracket 39 by screws 53 which pass through the slots 45 of the leg 42 of the mounting bracket 39 and cooperate with washers 54 and nuts 55 to arrest the intermediate plate 40 in a predetermined position relative to the mounting bracket 39. This predetermined position can be chosen by moving the intermediate plate 40 relative to the leg 42 within the range permitted by the slots 45, while the screws 53 are loose. This provides for the adjustment of the position of the intermediate plate 40 relative to the conveyor 13 in the transverse direction of the latter.

The bottom plate 37 of the arrangement 10 is provided with a plurality of circular holes 56 which are arranged in pairs along the bottom plate 37. The intermediate plate 40 has elongated slots 57 extending parallel to the longitudinal direction of the conveyor 13. Additional screws 58 cooperating with washers 59 extend through the slots 57 of the intermediate plate 40 and into the holes 56 of the bottom plate 37. This connection of the intermediate plate 40 to the bottom plate 37 provides for two additional possibilities of positional adjustment of the dispensing arrangement 10. One of these possibilities is the adjustment transversely of the conveyor 13, which is provided by the selection of the pairs of holes 56 into which the screws 58 are introduced. The other possibility is in the longitudinal direction of the conveyor 13, which is provided by the movement of the bottom plate 37 relative to the intermediate plate 40 within the range permitted by the slots 57, so long as the screws 58 are loose. The screws 58 may engage internal threads provided at the surfaces bounding the holes 56, or may cooperate with non-illustrated nuts, to secure the bottom plate 37 of the dispensing arrangement 10 to the intermediate plate 40 in any selected relative position.

Figure 6:
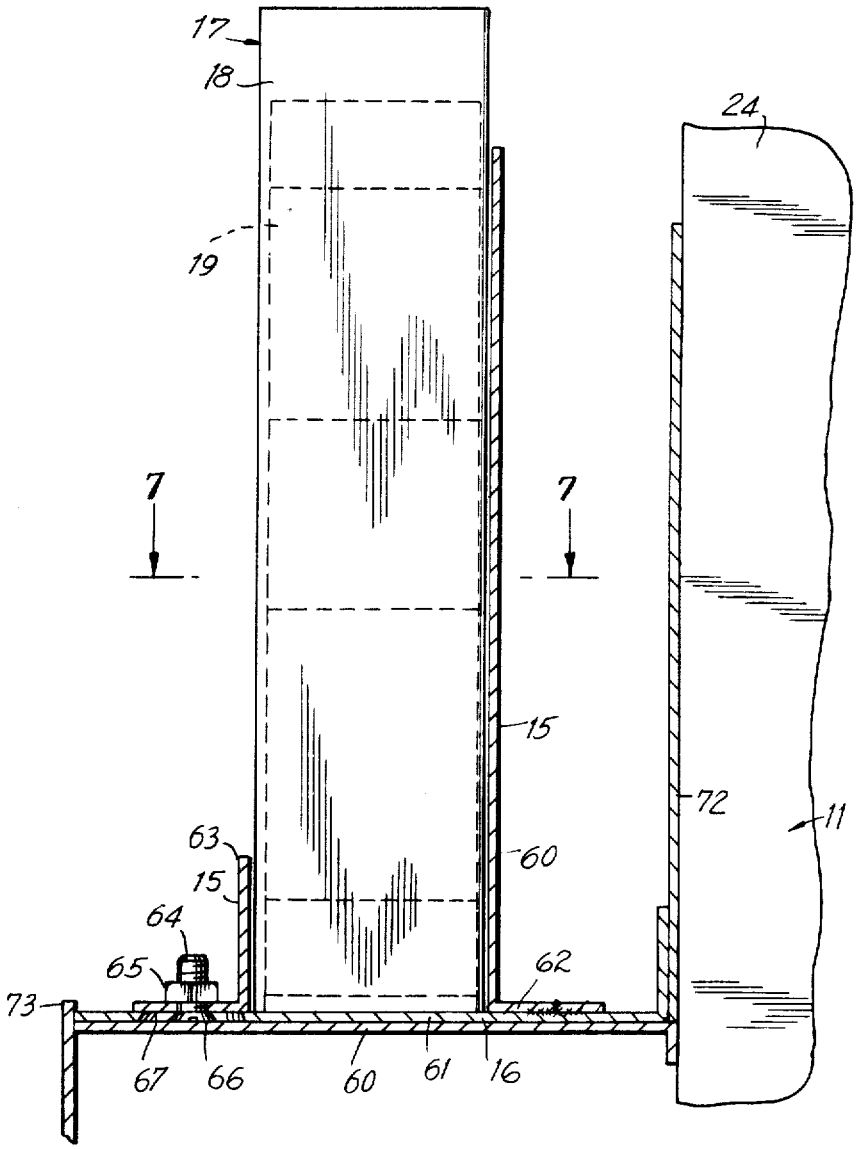
FIG. 6 is a sectional view taken along the plane 6—6 of FIG. 1.
Figure 7:
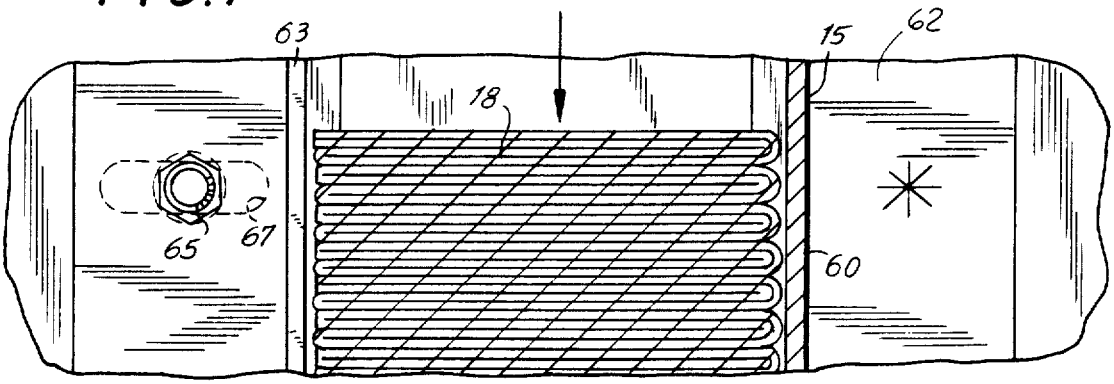
FIG. 7 is a sectional view of a detail taken along the plane 7—7 of FIG. 6, at an enlarged scale.

Still another possibility of adjustment is illustrated in FIGS. 6 and 7. It may be seen there that the chute 15 which bounds the channel 16 is mounted on a support wall 60 of the body 11, in a manner which will be disclosed more particularly later. The chute 15 includes, as its main components, a bottom wall 61 and two lateral or guiding walls 62 and 63. The lateral wall 62 is shown to be welded to the bottom wall 61 of the chute 15. On the other hand, the lateral wall 63 is connected to the bottom wall 61 by a plurality of screws 64 which cooperate with respective nuts 65. A head 66 of each of the screws 64 is arranged below the bottom plate 61 and engages the latter from below. The bottom plate 61 of the chute 15 is provided with a plurality of elongated slots 67 extending transversely relative to the channel 16, each receiving the shank of one of the screws 64. Upon loosening of the nut 65, the head 66 releases its hold on the bottom plate 61, so that the lateral wall 63 can be moved, together with the screw 64 and the nut 65, in the longitudinal direction of the slot 67, that is, transversely of the channel 16, thereby adjusting the width of the latter within the range determined by the length of the slot 67. Then, the nut will be tightened, so that the head 66 of the screw 64 firmly engages the bottom plate 61, thus arresting the lateral wall 63 in its then assumed selected position. The lateral wall 62 is spaced a certain distance away from the housing 24, such that the withdrawing roller 23 is substantially centered relative to the channel 16, as shown in FIG. 1.

As shown in FIGS. 2 and 5, and especially in FIG. 4, the bottom wall 61 of the chute 15 has a generally hook-shaped configuration at its end remote from the dispensing end 20, so that it embraces a projecting end portion 69 of the wall 60 of the body 11. The bottom wall 61 of the chute 15 further includes a reinforced lug 70 which carries a setting screw 71 that engages the body 11. Depending on the extent to which the setting screw 71 extends beyond the lug 71, which extent can be adjusted by turning the setting screw 71 in its threaded bore in the lug 70, the position of the chute 15 relative to the wall 60 of the body 11 can be adjusted in the longitudinal direction of the channel 16. It will be appreciated that, due to this mounting of the chute 15 on the body 11, and its confinement between lateral walls 72 and 73 of the body 11 as shown in FIG. 6, the chute 15 constitutes a removable accessory to the dispensing apparatus 10 which can thus be also used in the manner described in the aforementioned U.S. patent after the removal of the chute accessory 15.

FIG. 5 of the drawing indicates that the weight or pusher element 19 can also assume a different orientation in the channel 16 of the chute 15. This orientation is particularly useful while introducing or replenishing the stack 17 of the articles 18, since then the pusher element 19 is remote from the area at which the stacking takes place, and yet is close at hand and the dange of misplacement thereof is minimized. In this different orientation, a hook-shaped portion 74 of the pusher element 19, which is configurated to also constitute a convenient handgrip, engages behind the hook-shaped portion of the bottom wall 61 of the chute 15, so that sliding of the pusher element 19 down the channel 16 is prevented.

Figure 8:
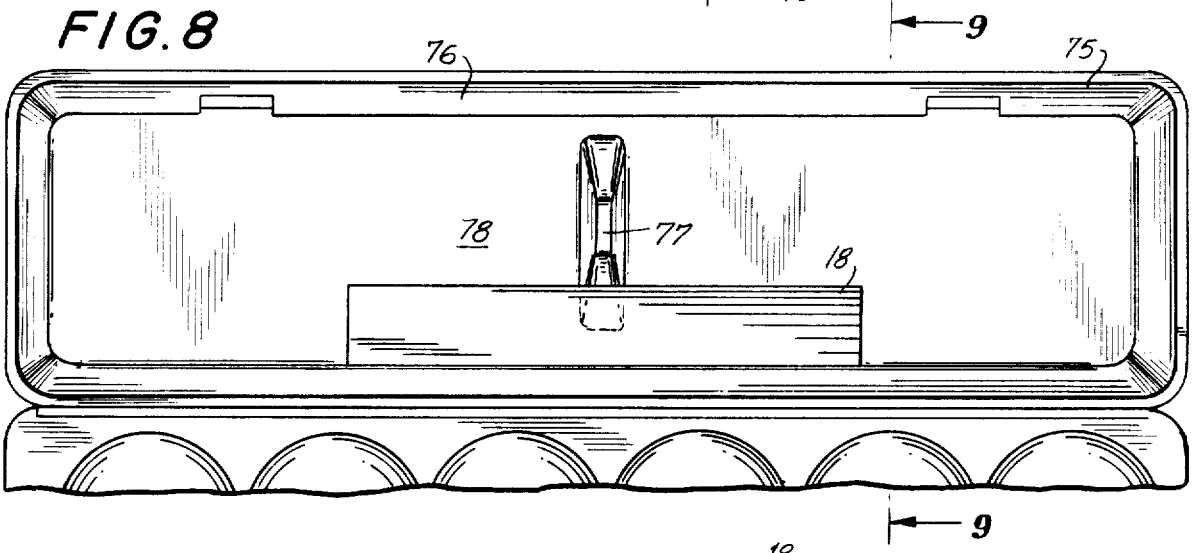
FIG. 8 is a top plan view of an egg carton of a different configuration than that shown in FIGS. 1 to 4, with a dispensed coupon positioned therein.
Figure 9:
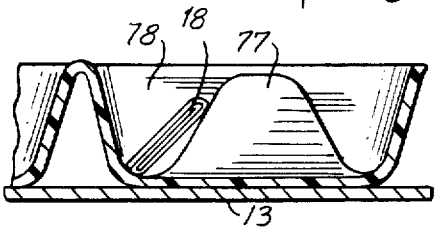
FIG. 9 is a fragmentary sectional view taken in the plane 9—9 of FIG. 8.

FIGS. 8 and 9 illustrate that the arrangement of the present invention can also be used for dispensing the folded articles 18 into egg cartons or similar containers 75 whose lid portions 76 are provided with differently configurated projections 77. In this case, the projection 77 extends transversely of the longitudinal direction of the container 75 and has sloping ends. Under these circumstances, the width of respective depressions 78 adjoining the sloping ends of the projection 77 is not sufficient to let the folded article 18 to rest in its entirety on the bottom of the depression 78. Thus, the folded article 18 leans on the sloping end of the projection 77. This, however, gives sufficient assurance that the article 18 will be safely retained in the depression 78 during the manipulations with the container 75 subsequent to the introduction of the folded article 18 into the depression 78 of the lid portion 76 of the container 75.

It will be understood that each of the elements described above, or two or more together, may also find a useful application in other types of arrangements differing from the type described above.

While the invention has been illustrated and described above as embodied in an arrangement for dispensing folded advertising coupon pairs into egg cartons provided with reinforcing projections in their lids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. An arrangement for dispensing articles of flexible sheet material into upwardly open containers, comprising means for bounding a channel for accommodating a stack of the articles in their folded state and for individually guiding the folded articles toward a dispensing end of said channel that is situated upwardly of the respective container during the dispensing operation, said channel having a bottom surface which slopes downwardly toward said dispensing end of said channel;

means for individually withdrawing the folded articles from said stack and for advancing the same toward and beyond the dispensing end of said channel during the dispensing operation for dispensing the respective folded articles into the respective containers; and a support body which supports said bounding means, and means for holding said support body at a predetermined position relative to the respective container at least during the dispensing operation, including a support assuming a predetermined position relative to the container during the dispensing operation, and means for mounting said support body on said support for displacement relative to the position of the container during the dispensing operation in two horizontal directions for adjustment of the position of said dispensing end of said channel relative to the container, and for maintaining said support body in the selected adjusted position thereof.

2. The arrangement as defined in claim 1 for use with containers having respective reinforcing ribs and adjacent depressions at those portions thereof onto which the folded articles are to be dispensed, wherein said dispensing end of said channel is situated upwardly of the respective depression during the dispensing operation.

3. The arrangement as defined in claim 2 for use with containers which are elongated in one horizontal direction as considered in the position assumed during the dispensing operation and whose reinforcing ribs extend longitudinally thereof and whose depressions have a predetermined width, wherein said channel has a width substantially corresponding to said predetermined width for accommodating said folded articles with a width at most equal to said predetermined width.

4. The arrangement as defined in claim 2 for use with containers which are elongated in one horizontal direction as considered in the position assumed during the dispensing operation and whose reinforcing ribs extend transversely of the longitudinal direction and slope into the depressions such that the depressions have a predetermined dimension between the crests of the reinforcing ribs and the bottoms thereof, wherein said channel has a width substantially corresponding to said predetermined dimension for accommodating said folded articles with a width at most equal to said predetermined dimension.

5. The arrangement as defined in claim 1, wherein each folded article includes a pair of coupons, each coupon being folded in half about a fold line and connected to the other coupon along an edge that is parallel to the fold line.

6. The arrangement as defined in claim 1, and further comprising means for maintaining the folded articles of the stack in substantially upright positions within said channel prior to the withdrawal thereof from the stack during the dispensing operation, including a pusher element of hollow configuration slidably supported on said inclined bottom surface at the opposite side of the stack from said dispensing end of said channel and engaging the last folded article of the stack.

7. The arrangement as defined in claim 6, wherein said pusher element is of a rigid sheet material.

8. The arrangement as defined in claim 6, wherein said bounding means includes a chute having an end portion at an end of said channel which is remote from said dispensing end; and wherein said pusher element has a substantially hook-shaped portion adapted to engage behind said end portion of said chute during the introduction of said folded articles into said channel.

9. The arrangement as defined in claim 8, wherein said pusher element is capable of assuming two different orientations in said channel, in one of which it engages the stack from behind and slides on said inclined bottom surface while said hook-shaped portion thereof extends away from said end portion of said chute, and in the other of which said hook-shaped portion engages behind said end portion of said chute and keeps said pusher element at a predetermined distance from the stack against sliding on said inclined bottom surface.

10. The arrangement as defined in claim 1, wherein said bounding means includes a chute having two lateral walls laterally delimiting said channel, at least one of said lateral walls being mounted on the remainder of said chute for displacement transversely of said channel for adjustment of the width of said channel, and being arrestable in the selected adjusted position thereof for maintaining the selected width of said channel.

11. The arrangement as defined in claim 1, wherein said mounting and maintaining means includes at least one bracket securable to said support and to said support body, said bracket having a substantially L-shaped configuration including two legs respectively juxtaposed with said support and with said support body, at least one of said legs having elongated slots therein, and respective screws extending through said slots.

12. The arrangement as defined in claim 11, wherein said mounting and maintaining means further includes an intermediate plate interposed between one of said legs of said bracket and said support body and having elongated slots therein, first additional screws extending through said slots and engaging said support body, and second additional screws securing said intermediate plate to said one leg of said bracket.

13. An arrangement for dispensing articles of flexible sheet material into upwardly open containers, comprising means for bounding a channel for accomodating a stack of the articles in their folded state and for individually guiding the folded articles toward a dispensing end of said channel that is situated upwardly of the respective container during the dispensing operation, said channel having a bottom surface which slopes downwardly toward said dispensing end of said channel;

means for individually withdrawing the folded articles from said stack and for advancing the same toward and beyond the dispensing end of said channel during the dispensing operation for dispensing the respective folded articles into the respective containers; and a support body for said bounding means, including an inclined support wall extending in the longitudinal direction of said channel, said bounding means including a chute separate from said support body and supported thereon, said chute including, at its end remote from said dispensing end of said channel, a substantially hook-shaped end portion which embraces a portion of said support wall.

14. The arrangement as defined in claim 13, wherein each folded article includes a pair of coupons, each coupon being folded in half about a fold line and connected to the other coupon along an edge that is parallel to the fold line.

15. The arrangement as defined in claim 13, wherein said support body bounds a recess extending in the longitudinal direction of said channel for receiving said chute.

16. The arrangement as defined in claim 15, wherein said chute includes a lug at said remote end thereof; and further including means for determining the position of said chute in said recess in the longitudinal direction of said channel; including a setting screw threadedly engaging said lug and abutting said support body to maintain said lug at a predetermined distance therefrom.

17. An arrangement for dispensing folded coupons into upwardly open, edge-hinged containers having respective reinforcing ribs on their lids located at respective predetermined spacings away from edge hinges pivotably connecting the lids along their edges to the remainder of the containers, comprising:

means for bounding a channel for accommodating a stack of the folded coupons, and for individually guiding the same toward a dispensing end of said channel that is situated upwardly of the respective container during the dispensing operation;

means for adjusting the position of the dispensing end of said channel to be in mutual alignment with the respective predetermined spacings; and means for individually withdrawing the folded coupons from said stack, and for advancing the same toward and beyond the dispensing end of said channel during the dispensing operation for dispensing the respective folded coupons into the respective aligned spacings between the hinges and the reinforcing ribs of the respective containers, whereby the coupons are reliably dispensed in said spacings of the containers so as not to interfere with the closing of the same with the coupons therein.

18. The arrangement as defined in claim 17, wherein said channel has a bottom surface which slopes downwardly toward said dispensing end of said channel.

19. The arrangement as defined in claim 17; and further comprising a support body which supports said bounding means, and means for holding said support body at a predetermined position relative to the respective container at least during the dispensing operation, including a support assuming a predetermined position relative to the container during the dispensing operation, and said adjusting means mounts said support body on said support for displacement relative to the position of the container during the dispensing operation in two horizontal directions for adjustment of the position of said dispensing end of said channel relative to the container, and maintains said support body in the selected adjusted position thereof.

20. The arrangement as defined in claim 17, further comprising a support body for said bounding means, including an inclined support wall extending in the longitudinal direction of said channel; and wherein said bounding means includes a chute separate from said support body and supported thereon, said chute including, at its end remote from said dispensing end of said channel, a substantially hook-shaped end portion which embraces a portion of said support wall.

21. The arrangement as defined in claim 17, wherein each folded coupon is folded in half about a fold line and is connected along an edge that is parallel to the fold line to another folded coupon.

22. In an arrangement for dispensing articles of flexible sheet material into upwardly open containers, a conversion accessory for converting the arrangement to dispense articles of different widths, comprising:

channel means for bounding a channel for accommodating a stack of non-folded articles of predetermined widths, and for individually guiding the non-folded articles toward a dispensing end of said channel that is situated upwardly of the respective container during the dispensing operation;

means for supporting said bounding means, including an inclined support wall extending in the longitudinal direction of said channel;

chute means for bounding a chute for accommodating a stack of folded articles of widths less than said predetermined widths, and for individually guiding said folded articles toward the dispensing end of said channel;

means for individually withdrawing the folded and non-folded articles from their respective stacks, and for advancing the same toward and beyond the dispensing end of said channel during the dispensing operation for dispensing the respective folded and non-folded articles into the respective containers; and means for detachably mounting the chute on said inclined support wall in said channel between a non-mounted position in which the non-folded articles are dispensed, and a mounted position in which the folded articles are dispensed.

23. The accessory as defined in claim 22, wherein said chute includes a substantial hook-shaped end portion which detachably hooks over a rear portion of said support wall.

24. The accessory as defined in claim 23, wherein said chute includes a lug at its end remote from the dispensing end of said channel; and further including means for determining the position of said chute in said channel, including a setting screw threadedly engaging said lug and abutting said support body to maintain said lug at a predetermined distance therefrom.

25. The arrangement as defined in claim 22, wherein each folded article includes a pair of coupons, each coupon being folded in half about a fold line and connected to the other coupon along an edge that is parallel to the fold line.

* * * * *